US006506089B2

(12) United States Patent
Nakanishi et al.

(10) Patent No.: US 6,506,089 B2
(45) **Date of Patent: *Jan. 14, 2003**

(54) MANUFACTURING METHOD OF IMAGE FORMING APPARATUS, MANUFACTURING APPARATUS OF IMAGE FORMING APPARATUS, AND MANUFACTURING METHOD OF PANEL APPARATUS

(75) Inventors: Koichiro Nakanishi, Yokohama (JP); Osamu Takamatsu, Atsugi (JP); Masahiro Tagawa, Isehara (JP); Shinya Koyama, Zama (JP); Kazuyuki Ueda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/794,501

(22) Filed: Feb. 28, 2001

(65) Prior Publication Data

US 2001/0009836 A1 Jul. 26, 2001

Related U.S. Application Data

(62) Division of application No. 09/141,414, filed on Aug. 27, 1998.

(30) Foreign Application Priority Data

Aug. 29, 1997 (JP) ..... 9-234289
Aug. 27, 1998 (JP) ..... 10-241815

(51) Int. Cl.[7] ..... H01J 9/26

(52) U.S. Cl. ..... 445/25; 445/43

(58) Field of Search ..... 445/25, 6, 24, 445/43

(56) References Cited

U.S. PATENT DOCUMENTS 5,564,958 A * 10/1996 Itoh et al. ..... 445/6
5,591,061 A 1/1997 Ikeda et al.
5,697,825 A 12/1997 Dynka et al. ..... 445/25

(List continued on next page.)

FOREIGN PATENT DOCUMENTS

EP 0 782 165 7/1997
EP 0 788 130 8/1997
JP 57-176641 10/1982

(List continued on next page.)

OTHER PUBLICATIONS

Araki, H., et al., "Electroforming and Electron Emission of Carbon Thin Films," Vacuum, vol. 26, No. 1 (1983).

(List continued on next page.)

*Primary Examiner*—Kenneth J. Ramsey
(74) *Attorney, Agent, or Firm*—Fitzpatrick, Cella, Harper & Scinto

(57) ABSTRACT

To obtain a stable image forming apparatus of a high quality without a luminance fluctuation and a color mixture due to a positional deviation, the following construction is disclosed. A method of manufacturing an image display apparatus in which a first substrate on which fluorescent body exciting means is arranged and a second substrate on which a fluorescent body that emits light by the fluorescent body exciting means is arranged are arranged so as to face each other and are adhered through joining members at their peripheries, wherein a seal bonding step of adhering the first and second substrates through a joining members and a step of performing a position matching of the first and second substrates are executed in a vacuum.

28 Claims, 10 Drawing Sheets

U.S. PATENT DOCUMENTS

| | | | | | |
|---|---|---|---|---|---|
| 5,788,551 | A | | 8/1998 | Dynka et al. | 445/25 |
| 5,807,154 | A | * | 9/1998 | Watkins | 445/25 |
| 5,813,893 | A | | 9/1998 | Robinson | |
| 5,855,637 | A | * | 1/1999 | Yakou et al. | 445/25 |
| 5,997,378 | A | | 12/1999 | Dynka et al. | 445/25 |
| 6,036,568 | A | * | 3/2000 | Murouchi et al. | 445/25 |
| 6,254,449 | B1 | * | 7/2001 | Nakanishi et al. | 445/25 |

FOREIGN PATENT DOCUMENTS

| | | |
|---|---|---|
| JP | 59-108238 | 6/1984 |
| JP | 61-42837 | 3/1986 |
| JP | 61-042837 | 3/1986 |
| JP | 62-285340 | 12/1987 |
| JP | 2-10542 | 3/1990 |
| JP | 3-40336 | 2/1991 |
| JP | 03-040336 | 2/1991 |
| JP | 03-272544 | 12/1991 |
| JP | 3-272544 | 12/1991 |
| JP | 5-114373 | 5/1993 |
| JP | 05-114373 | 5/1993 |
| JP | 6-196094 | 7/1994 |
| JP | 7-235255 | 9/1995 |
| JP | 9-171768 | 6/1997 |

OTHER PUBLICATIONS

Dittmer, G., "Electrical Conduction and Electron Emission of Discontinuous Thin Films," Thin Solid Films, vol. 9 (1972).

Dyke, W.P., et al., "Field Emission," Advances in Electronics and Electron Physics, vol. 8, (1956).

Elinson, M.I., et al., "The Emission of Hot Electrons and the Field Emission of Electrons from Tin Oxide,", Radio Eng. Electronic Physics, vol. 10, (1965).

Hartwell, M., et al., Strong Electron Emission from Patterned Tin–Indium Oxide Thin Films, IEEE Trans. ED Conf. (1975).

Mead, C.A., "Operation of Tunnel–Emission Devices", Journ. of Appl. Physics, vol. 32, No. 4 (1961).

Spindt, C.A., et al., Physical Properties of Thin–Film Field Emission Cathodes with Molybdenum Cones, Journ. of Appl. Physics, vol. 47, No. 12 (1976).

* cited by examiner

MANUFACTURING METHOD OF IMAGE FORMING APPARATUS, MANUFACTURING APPARATUS OF IMAGE FORMING APPARATUS, AND MANUFACTURING METHOD OF PANEL APPARATUS

This application is a division of application Ser. No. 09/141,414, filed on Aug. 27, 1998.

BACKGROUND OF THE INVENTION

1. Field of the Invention

The invention relates to a manufacturing method of an image forming apparatus, a manufacturing apparatus of an image forming apparatus, and the image forming apparatus manufactured by the manufacturing method.

2. Related Background Art

Hitherto, as electron emitting devices, mainly, two kinds of devices, i.e., a device using a thermionic emitting device and a device using a cold cathode electron emitting device have been known. As cold cathode electron emitting devices, there are a field emission type (hereinafter, abbreviated as an FE type), a metal/insulating layer/metal type (hereinafter, abbreviated as an MIM type), a surface conducting type electron emitting device, and the like.

As an example of the FE type, there has been known a device disclosed in W. P. Dyke & W. W. Dolan, "Field Emission", Advances in Electron Physics, 8,89, 1956, C. A. Spindt, "Physical Properties of Thin-Film Field, Emission Cathodes with Molybdenum Cones", J. Appl. Phys., 47,5248, 1976, or the like.

As an example of the MIM type, there has been known a device disclosed in C. A. Mead, "Operation of Tunnel-Emission Devices", J. Appl. Phys., 32,646, 1961, or the like.

As an example of the surface conducting type electron emitting device, there has been known a device disclosed in M. I. Elinson, Radio Eng. Electron Phys., 10,1290, 1965, or the like.

The surface conducting type electron emitting device uses a phenomenon in which an electron emission occurs by the supplying of current to a thin film of small area formed on a substrate so as to be in parallel with the film surface. As a surface conducting type electron emitting device, there has been reported a device using a $SnO_2$ thin film by Elinson et al., mentioned above, a device using an Au thin film [G. Dittmer, "Thin Solid Films", 9,317, 1972], a device using an $In_2O_3/SnO_2$ thin film [M. Hartwell and C. G. Fonstad, IEEE Trans. ED Conf., 519, 1975], a device using a carbon thin film [Hisashi Araki, et al., Vacuum, Vol. 26, No. 1, pages 22, 1983], or the like.

As a typical device construction of those surface conducting type electron emitting devices, a device construction of M. Hartwell mentioned above is diagrammatically shown in FIGS. 7A and 7B.

In FIGS. 7A and 7B, reference numeral 71 denotes a substrate; 72 and 73 element electrodes; and 74 a conductive film made of a metal oxide thin film or the like formed in an H-shaped pattern by sputtering. An electron emitting portion 75 is formed by a current supplying process called a current supply forming, which will be explained hereinbelow. An interval L between the element electrodes in the diagram is set to 0.5 to 1 mm and W' is set to 0.1 mm.

Hitherto, in those surface conducting type electron emitting devices, generally, the electron emitting portion 75 is preliminarily formed by subjecting the conductive film 74 to the current supplying process called a current supply forming prior to performing an electron emission. That is, in the current supply forming, a DC voltage or a voltage of very moderately increased magnitude, for example, at a rate about 1 V/min, is applied across the conductive thin film 74 so that a current flows, thereby locally breaking, deforming, or degenerating the conductive thin film and forming the electron emitting portion 75 in an electrically high resistance state.

In the electron emitting portion 75, a crack occurs in a part of the conductive film 74, and an electron emission is performed from a portion near the crack. In the surface conducting type electron emitting device on which the current supply forming process has been performed, a voltage is applied to the conductive thin film 74 and a current is supplied to the device, thereby emitting electrons from the electron emitting portion 75.

In the surface conducting type electron emitting device, a method whereby carbon or/and its compound are formed in the electron emitting portion of the surface conducting type electron emitting device by a new manufacturing method called an activating step, thereby remarkably improving electron emitting characteristics, has been proposed (JP-A-7-235255).

According to the activating step, in the manufacturing method of the surface conducting type electron emitting device, a device in which a pair of electrodes and a conductive film are formed is put in a vacuum ambience and is subjected to a forming step, and thereafter, organic material gas having carbon is introduced into the vacuum ambience, and a pulse-like voltage which is properly selected is applied to the device for a few to several tens of minutes. According to this step, the characteristics of the electron emitting device, namely, an electron emission current Ie, remarkably increases and is improved while keeping unchanged a threshold value for the voltage.

However, in the image forming apparatus using the above conventional electron emitting device, there is a case where the following problems occur.

(1) In a large image forming apparatus, an electron source substrate (rear plate) on which a plurality of electron emitting devices are formed and a face plate on which a fluorescent body or the like is formed are positioned so as to keep desired relative positions, and are assembled and temporarily fixed at a predetermined distance of a few millimeters or less, and thereafter, the temperature is raised up to a temperature at which an adhering material such as frit glass or the like is softened, and a pressure is applied so that those plates are adhered, together with a space between them thereby forming a vacuum envelope (this step is called a heat seal bonding step). However, since the distance between the electron source substrate and the face plate is short and the conductance of the gas is small, in an exhausting step in the image forming apparatus subsequent to the seal bonding step, it takes time to exhaust the space to an adequate degree of vacuum through an exhaust pipe or, if the exhausting step is finished in a short time, the degree of vacuum in the apparatus is low, or a pressure fluctuation occurs. There is, consequently, a case where a degree of vacuum which is necessary for stable electron emitting characteristics cannot be obtained.

Although a high positioning precision is required in the relative arrangement between the electron emitting device and the fluorescent body in order to prevent a color deviation or the like, there is a case where the necessary positional precision cannot be obtained due to the positional deviation or the like due to a thermal expansion in the seal bonding step or the softening of frit glass that is used for seal bonding. As a device in which they are seal bonded in the vacuum, a method of using rod glass of a low melting point and adhering and introducing into a vacuum apparatus has been disclosed in JP-A-6-196094. Even in this case, however, postional deviation during the frit melting cannot be avoided.

Further, in a case where the electron emitting device which is used in the image forming apparatus is a surface conducting type electron emitting device, in the introduction of the gas into the vacuum envelope in association with the activating step of the surface conducting type electron emitting device, the gas is introduced through the exhaust pipe into the vacuum envelope in which the face plate and the rear plate are adhered while keeping the distance therebetween to a few millimeters or less. There are, consequently, problems in manufacturing such as that the conductance of the exhaust pipe and the vacuum envelope for the gas is small, it is difficult to obtain a constant pressure for a whole region in the vessel (vacuum envelope), it takes time until the pressure is stabilized, and the like.

(2) In the surface conducting type electron emitting device, after the activating step is performed, the gas used in the activating step and water, oxygen, CO, $CO_2$, hydrogen, and the like are adsorbed to the electron source substrate or the material constructing the image forming apparatus, for example, the face plate having the fluorescent body. It is necessary to eliminate the adsorbed gas or the like in order to realize the stabilization of the electron emitting characteristics and to prevent a discharge by the remaining gas or the like. For this purpose, a step of exhausting through the exhaust pipe while baking the vacuum envelope after the seal bonding step, is needed.

According to the above step, however, since the conductance of the vessel and the exhaust pipe for the gas is small, the gas which is generated from the material cannot be always sufficiently exhausted and the stable electron emitting characteristics cannot be obtained, and there is a case of occurrence of a luminance fluctuation, decrease in life, and the like.

Further, a consistent manufacturing apparatus of the image forming apparatus which can solve the above problems and in which a re-contamination due to a re-adsorption of water, oxygen, hydrogen, CO, $CO_2$, or the like to each of the degassed members does not occur, is demanded.

It is an object of the invention to provide an excellent manufacturing method and manufacturing apparatus of an image forming apparatus which can solve the foregoing problems, and to provide the image forming apparatus which is obtained by use of the manufacturing method and manufacturing apparatus.

SUMMARY OF THE INVENTION

To accomplish the above object, according to the invention, there is provided a method of manufacturing an image display apparatus, whereby a first substrate on which fluorescent body exciting means is arranged and a second substrate in which a fluorescent body which emits light by the fluorescent body exciting means is arranged are arranged so as to face each other and are adhered through joining members at their peripheries, wherein a seal bonding step of adhering the first and second substrates through the joining members and a step of position matching the first and second substrates are executed in a vacuum.

According to the invention, there is provided an apparatus for manufacturing an image display apparatus in which a first substrate on which fluorescent body exciting means is arranged and a second substrate in which a fluorescent body which emits light by the fluorescent body exciting means is arranged are adhered through joining members at their peripheries, comprising: a vacuum chamber; position adjusting means for moving the first substrate and/or the second substrate into the vacuum chamber in X, Y, and θ directions; position adjusting means for moving the first substrate or the second substrate in a Z direction; heating means for heating the first and second substrates; and exhausting means for exhausting the inside of the vacuum chamber.

According to the invention, there are disclosed the image forming apparatus manufactured by the manufacturing method of the image forming apparatus of the invention and the image forming apparatus manufactured by the manufacturing apparatus of the image forming apparatus of the invention.

According to the invention, there is provided a manufacturing method of an image forming apparatus, whereby a step of seal bonding a plurality of members constructing a vacuum envelope including an electron source and an image forming member is executed in a vacuum ambience and the seal bonding step comprises: a step of heating and performing an evacuation while keeping the electron source and the image forming member at a desired distance; and a step of observing a relative positional relation of the electron source and the image forming member and adhering the plurality of members constructing the vacuum envelope while keeping a predetermined positional relation between the electron source and the image forming member at a temperature near a seal bonding temperature. According to this manufacturing method, since the vacuum envelope is formed by adhering the members while keeping the electron source and the image forming member in a predetermined positional relation at a temperature near the seal bonding temperature, the deviation of the relative position due to the thermal expansion, softening of frit glass, or the like can be corrected, and the power source substrate and the face plate can be adhered at a high positional precision.

The temperature is raised to the seal bonding temperature by separating the electron source substrate and the face plate at only an interval such that an enough conductance for the gas can be obtained and a degassing from the members is sufficiently executed and, after that, they are adhered, so that the vacuum vessel of a high vacuum degree can be formed and the stable electron emitting characteristics can be obtained. In a case of using the surface conducting type electron emitting device, by introducing the activating gas by separating the electron source substrate and the face plate at only an interval such that an enough conductance for the gas can be obtained, the activating gas can be easily introduced to the electron source substrate and the activation can be uniformly performed.

Further, the temperature is raised to the seal bonding temperature while keeping an interval between the electron source substrate and the face plate, and the seal bonding together with exhaustion, thereby performing this step together with the step of removing the activating gas or the like adhered to the member. Therefore, the vacuum degree which exerts an influence on the electron emitting characteristics can be improved and the heat processing step can be reduced.

That is, one of the inventions of the manufacturing method of the image forming apparatus according to the invention can be said as follows.

It is a manufacturing method of an image forming apparatus having a first substrate and a second substrate, in which the first and second substrates are arranged so as to face each other, a space that is airtight with respect to the outside is provided between the first and second substrates, and a fluorescent body and means for exciting the fluorescent body are provided in the airtight space, comprising:

a seal bonding step of adhering the first and second substrates through joining members; and position matching step of matching relative positions of the first and second substrates, wherein the seal bonding step and the position matching step are executed in a desired ambience different from the atmospheric ambience.

It is also a manufacturing method of an image forming apparatus having a first substrate and a second substrate, in which the first and second substrates are arranged so as to face each other, a space that is airtight for the outside is provided between the first and second substrates, and a fluorescent body and means for exciting the fluorescent body are provided in the airtight space, comprising:

a heating step of heating joining members in order to adhere the first substrate and the second substrate through the joining members; and a position matching step of matching relative positions of the first and second substrates in a state where the joining members are heated wherein, also, it is suitable that the heating and positioning steps are performed in a desired atmosphere.

According to the above inventions, the airtight space is formed by adhering the first and second substrates. A frame or a spacer can be also provided between the first and second substrates. The ambience upon adhering is reflected to the ambience of the airtight space. Therefore, it is sufficient to adjust the ambience upon adhering to an ambience such that the inside of the airtight space becomes a requested ambience. In this instance, by performing the adjustment of the ambience in a state where the interval between the first and second substrates is larger than the interval after they were adhered, the adjusted ambience can be more easily reflected to the ambience of the airtight space (portion which becomes the airtight space after adhering), so that the above method is preferable.

One of the inventions of the manufacturing apparatuses of the image forming apparatus regarding the invention can be also said as follows.

It is a manufacturing apparatus of an image forming apparatus having a first substrate and a second substrate, in which the first and second substrates are arranged so as to face each other, a space that is airtight for the outside is provided between the first and second substrates, and a fluorescent body and means for exciting the fluorescent body are provided in the airtight space, comprising:

a chamber which can set an inner ambience to a desired ambience; heating means for heating joining members in the chamber in order to adhere the first and second substrates through the joining members; and position matching means for matching relative positions of the first and second substrates in the chamber in a state where the joining members are heated.

The present invention also provides a method of manufacturing a panel device provided with first and second substrates arranged in opposition to each other and bonded together comprising steps of:

adjusting relative positions of the first and second substrates; and pressing to bond the first and second substrates with common means; and provides a method of manufacturing a panel provided with first and second substrates arranged in opposition to each other and bonded together comprising steps of:

moving relatively first holding means for holding the first substrate and second holding means for holding the second substrate, thereby adjusting positions thereof; and approaching the first and second holding means to each other, thereby pressing to bond the first and second substrates together.

According to the above manufacturing method, wherein the adjusting the position and the bonding are performed at a heating state, the positions can be adjusted in a high accuracy desirably. And, the position adjusting and the pressing may be performed in a desired atmosphere.

Further present invention provides an apparatus for manufacturing a panel device provided with first and second substrates arranged in opposition to each other and bonded together comprising:

adjusting means for adjusting relative positions of the first and second substrates, the adjusting means also operating to press the first and second substrates thereby bonding the substrates together.

DETAILED DESCRIPTION OF THE PREFERRED EMBODIMENTS

An embodiment of the invention will now be specifically explained hereinbelow.

Figure 1A:
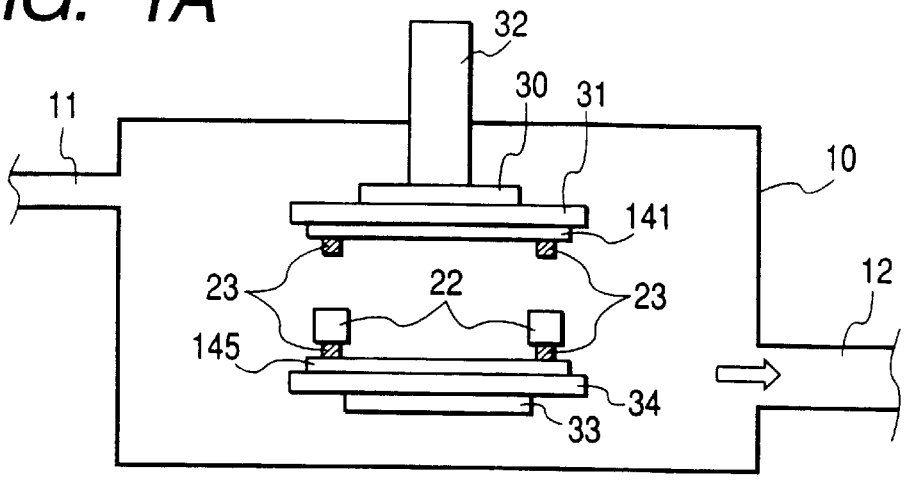
FIGS. 1A, 1B and 1C are explanatory diagrams of a manufacturing step showing conceptually a manufacturing method of the invention.
Figure 1B:
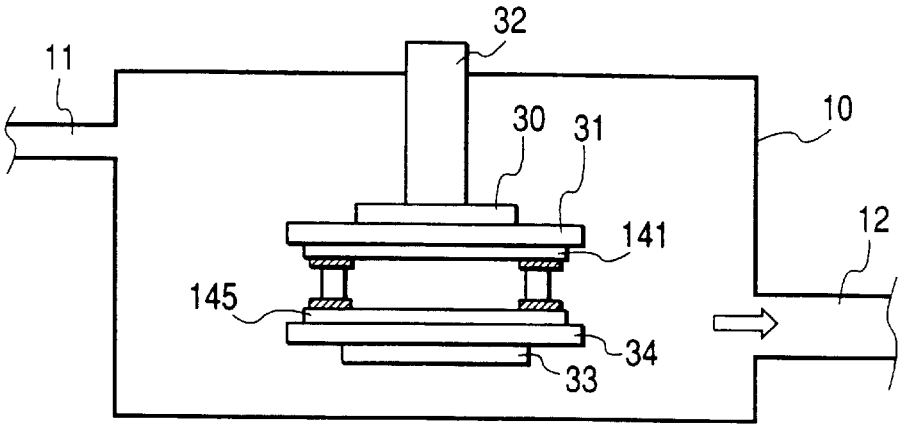
Figure 1C:
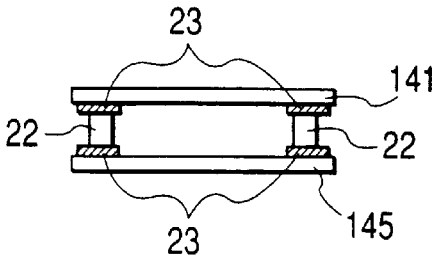

FIGS. 1A to 1C show an example of a manufacturing method of the invention and a manufacturing apparatus for a flat plate type image forming apparatus. In FIGS. 1A to 1C, reference numeral 10 denotes a vacuum chamber; 11 a gas introducing pipe for introducing gas or the like which is used in an activating step or the like into the vacuum chamber; 12 an exhaust pipe for evacuation; 141 a face plate including an image display portion; 145 a rear plate on which an electron source is formed; 22 a supporting frame; and 23 joining members for connecting the face plate 141, rear plate 145, and supporting frame 22. The joining member 23 is a frit glass which is mainly made of glass of a low melting point.

In FIGS. 1A to 1C, although the joining members 23 have previously been formed on the face plate and the rear plate, they can also be preliminarily formed on joining surfaces of the supporting frame 22 to the face plate and the rear plate. It is desired to remove an organic substance from the frit glass in advance by temporary baking.

Reference numeral 30 denotes a stage serving as position adjusting means for adjusting positions in X, Y, and θ directions of the face plate; 31 a heating plate serving as heating means for heating the face plate; and 32 means for adjusting a position in a Z direction of the face plate. The position adjusting means 32 also serves as a mechanism to press the face plate, rear plate, and supporting frame after they have come into contact with each other. Reference numeral 33 denotes a stage serving as position adjusting means for adjusting positions in the X, Y, and θ directions of the rear plate. Reference numeral 34 denotes a heating plate serving as heating means for heating the rear plate.

In FIGS. 1A to 1C, although the face plate is attached at the upper position of the apparatus and the rear plate is attached at the lower position of the apparatus, their attaching positions are not limited to those positions. It is sufficient to properly select which one of the plates should be attached at the upper position. The stages 30 and 33 serving as the position adjusting means in the X, Y, and θ directions of the face plate and the rear plate are not always necessary for both the face plate and the rear plate. It is desirable to have a heat insulating structure such as a heat insulating material or the like between the heating plate and each of the stages 30 and 33.

The face plate 141 and rear plate 145 are fixed to the heating plates 31 and 34 by respective fixing tools (not shown). In this instance, if the electron source uses the surface conducting type electron emitting device, the foregoing forming can be performed in advance or can be executed in the vacuum chamber. The frit glasses are preliminarily arranged at joining portions of the supporting frame 22 to the rear plate 145 and face plate 141, respectively.

When a large display panel is constructed, an atmospheric pressure proofing structure called a spacer is adhered in advance to the face plate side or the electron source side. In this instance, however, it is also possible simultaneously to adhere the supporting frame to the face plate side or the electron source side. As mentioned above, the face plate and the electron source (rear plate) are fixed to the heating plates 31 and 34, respectively, and the evacuation is performed from the exhaust pipe 12 at a distance such that a sufficient conductance for the gas can be assured while raising the temperature to a temperature near a softening point of the glass frit.

If the electron source uses the surface conducting type electron emitting device, the operations of introducing the activating gas while keeping the conductance (state where the face plate and the rear plate are separated at a distance that is equal to or higher than a height of supporting frame), performing the foregoing activation and, after that, performing the; and evacuation while raising the temperature to a temperature near the softening point of the glass frit are preferable to avoid adverse effects due to the adsorption or the like of the activating gas. Heating in a state where the gas remains to a certain extent is preferable because the face plate, rear plate, supporting frame, and the like are uniformly heated (refer to FIG. 1A).

The evacuation is sufficiently performed. Confirmation is obtained that an amount of degassing from the member or an amount of water, oxygen, or the like which is generated from the glass frit is equal to or less than a desired value, by means of an apparatus for measuring an ambience in the chamber. After that, while adjusting the relative positional relation between the face plate and the rear plate by using the adjusting stage 30 in the X, Y, and θ directions of the face plate, the adjusting stage 33 in the X, Y, and θ directions of the rear plate, or both of the stages 30 and 33 so as to keep a predetermined positional relation between the face plate and the rear plate, the face plate, rear plate, and supporting frame are brought into contact with each other by using the adjusting mechanism in the Z direction of the face plate, and a pressurization is performed.

After the temperature has been held while applying the pressure for a predetermined time and after adjusting the relative positions of the face plate and the rear plate, the temperature is reduced in accordance with a predetermined temperature profile and the glass frit is hardened and is adhered (refer to FIG. 1B).

The adjustment of the relative positions of the face plate and rear plate is executed until a state where the temperature decreases to a desired temperature from the softening point of the glass frit and a certain degree of flowability is held (although) the frit starts to be hardened), is obtained.

Further, after the temperature reduced and the glass frit is perfectly hardened, it is gradually cooled to about room temperature and the structure is taken out from the vacuum chamber (refer to FIG. 1C). Although the surface conducting type electron emitting device has been used here as an electron emitting device, the invention is not limited to it. As an electron emitting device, the foregoing cold cathode electron emitting device such as a field emission type electron emitting device or the like may be used.

Further, when the field emission type electron emitting device is used as an electron emitting device, hydrogen is introduced from the gas introducing pipe 11 prior to seal bonding, hydrogen is left in the seal bonded vacuum chamber, and the aging deterioration of electron emitting characteristics by oxidation of an emitter can be suppressed. A partial pressure of hydrogen is preferably set to a value within a range of about $10^{-7}$ to $10^{-3}$ millibars.

If the gas introducing pipe 11 used for introduction of the activating gas is used to introduce gas to generate plasma, it can be also applied to manufacture a plasma display panel (PDP). As mentioned above, the manufacturing apparatus of the invention can be flexibly applied to any type so long as it is a flat type image forming apparatus.

EMBODIMENTS

Although the invention will be described further in detail by reference to the preferred embodiments, the invention is not limited by those embodiments.

Embodiment 1

Figure 2:
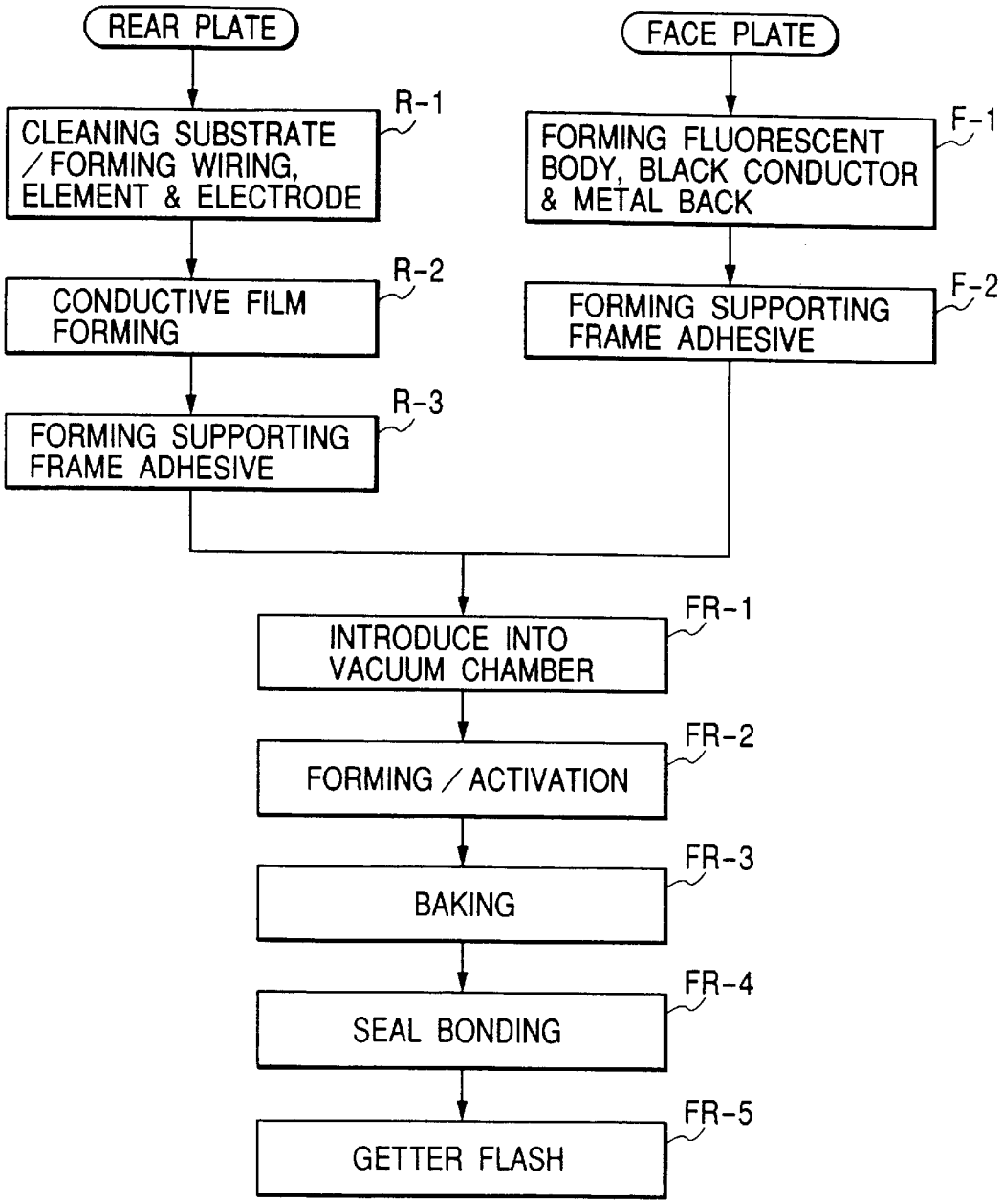
FIG. 2 is a block diagram showing a flow for a manufacturing step of a manufacturing method of an image forming apparatus according to an embodiment 1.
Figure 3:
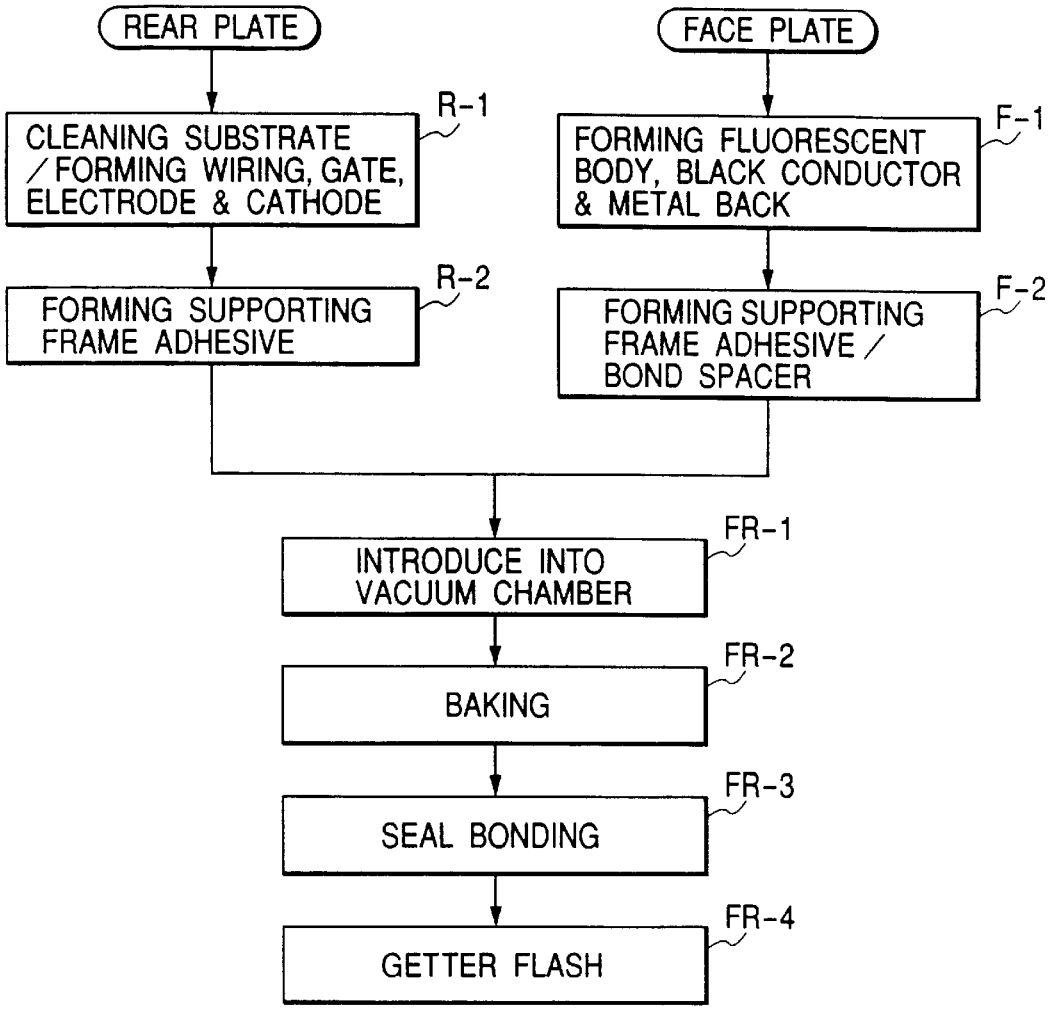
FIG. 3 is a block diagram showing a flow for a manufacturing step of a manufacturing method of an image forming apparatus according to an embodiment 2.
Figure 6:
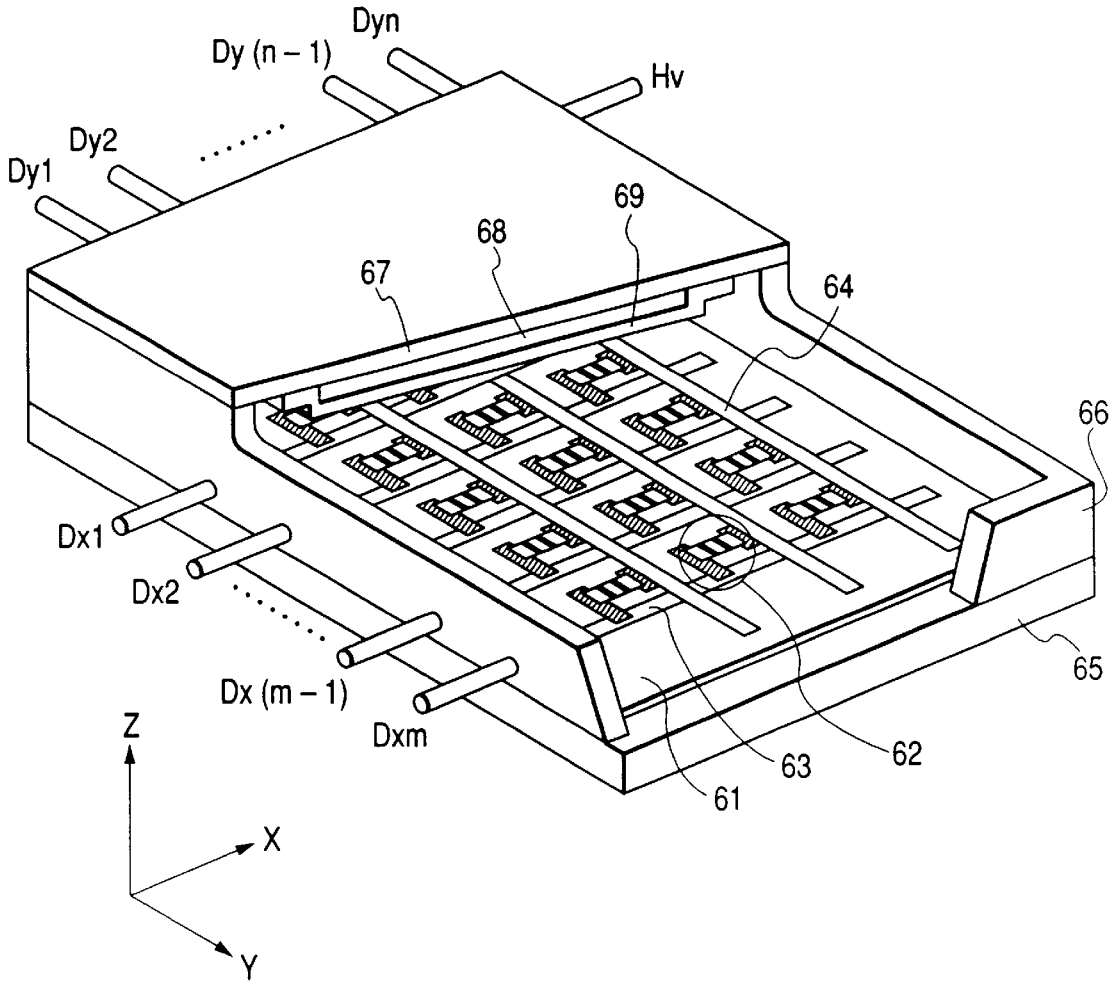
FIG. 6 is a perspective view showing the image forming apparatus manufactured by the embodiment 1.

In the first embodiment of the invention, an image forming apparatus with a construction shown in FIG. 6 is manufactured. In the embodiment, a plurality of surface conducting type electron emitting devices serving as cold cathode electron emitting devices are formed as electron emitting devices on the rear plate. A fluorescent body is attached on the face plate. A color image forming apparatus having an aspect ratio of 4:3 in which a valid display area has a diagonal line of 15 inches is formed. First, the image forming apparatus of the invention will be described with reference to FIG. 6 and its manufacturing method will be subsequently described with reference to FIG. 2 showing a manufacturing flow together with FIGS. 1A to 1C.

FIG. 6 is a perspective view of the image forming apparatus used in this embodiment a part of a panel is cut away to show an internal structure.

In the diagram, reference numeral 65 denotes a rear plate; 66 a supporting frame; and 67 a face plate. An airtight vessel to maintain the inside of the display panel in a vacuum state is formed by those component elements 65 to 67. When the airtight vessel is assembled, it is necessary to seal bond in order to hold enough strength and airtightness in the junction of each member.

(N×M) surface conducting type emitting devices 62 are formed on the rear plate 65. (N and M are positive integers of 2 or more and are properly set in accordance with the desired number of display pixels. For example, in a display apparatus for the purpose of display of a high definition television, it is desirable to set the numbers of N=3000 and M=1000 or more. In this embodiment, N=333 and M=250).

Figure 7A:
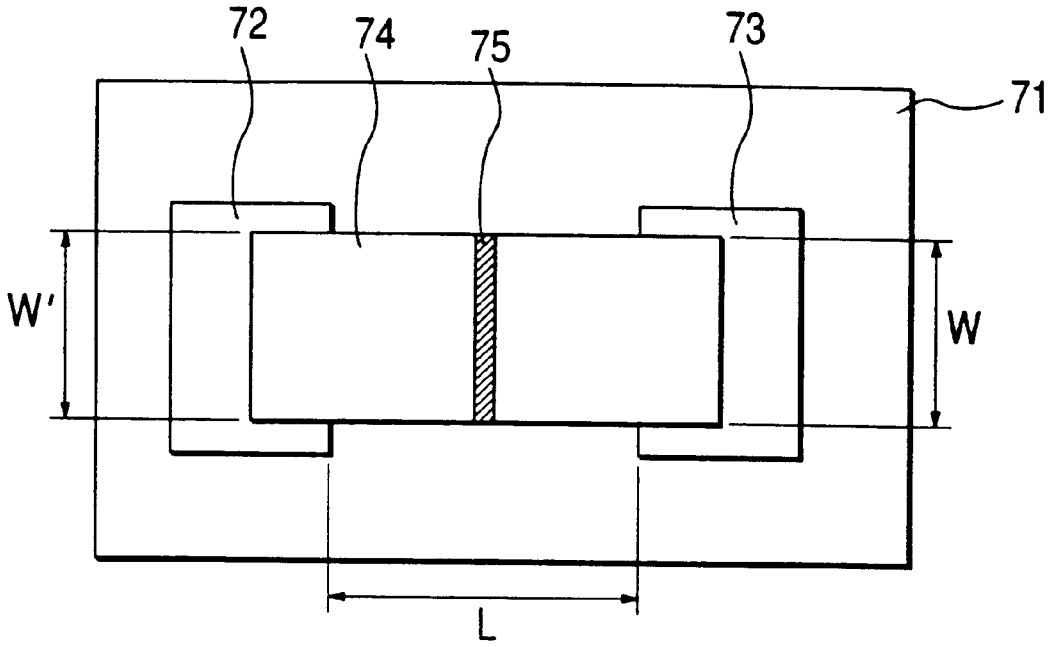
FIGS. 7A and 7B are schematic diagrams showing a surface conducting type electron emitting device of a cold cathode used in the embodiment 1.
Figure 7B:
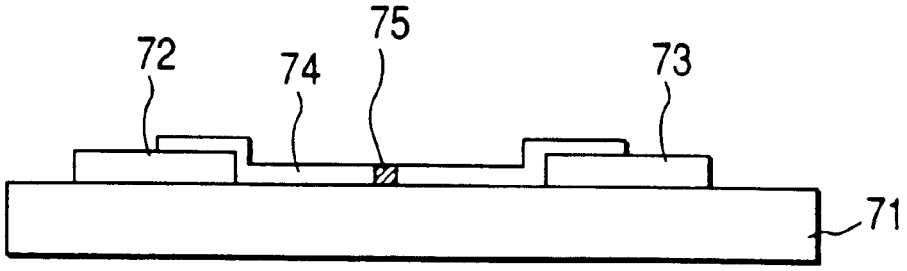

The (N×M) surface conducting type emitting devices are a simple matrix wired by M row-direction wirings 63 (also referred to as lower wirings) and N column-direction wirings 64 (also called upper wirings). Explanation will be further made with reference to FIGS. 7A and 7B. FIGS. 7A and 7B are schematic diagrams showing a construction of the surface conducting type electron emitting device. FIG. 7A is a plan view and FIG. 7B is a cross-sectional view. In FIGS. 7A and 7B, reference numeral 71 denotes the substrate, 72 and 73 the element electrodes, 74 the conductive thin film, and 75 the electron emitting portion.

By performing the forming process on the conductive thin film 74 through the element electrodes 72 and 73, the conductive thin film is locally broken, deformed, or degenerated, thereby forming the electron emitting portion 75 in the electrically high resistance state. Further, in the activating step of remarkably improving an emission current, a voltage is applied to the conductive thin film 74 of the surface conducting type electron emitting device and a current is supplied to the device, thereby emitting electrons from the electron emitting portion 75 (similar to the example of JP-A-7-235255 mentioned in the related background art).

A fluorescent film 68 is formed under the face plate 67. Since the embodiment relates to a color display apparatus, fluorescent bodies of three primary colors of red, green, and blue which are used in the field of the CRT are separately coated to the portion of the fluorescent film 68. The fluorescent body of each color is separately coated like stripes as shown in, for example, FIG. 8A. A black conductive body 81 is formed between the stripes of the fluorescent body.

The purposes of the black conductive bodies 81 are to prevent the occurrence of a deviation of a display color even if there is a slight deviation of an irradiating position of an electron beam, to prevent deterioration of a display contrast by preventing the reflection of external light, to prevent a charge-up of the fluorescent film by the electron beam, and the like. Although black lead is used as a main component in the black conductive body 81, any other material can also be used so long as it is suitable for the above objects.

Figure 8A:
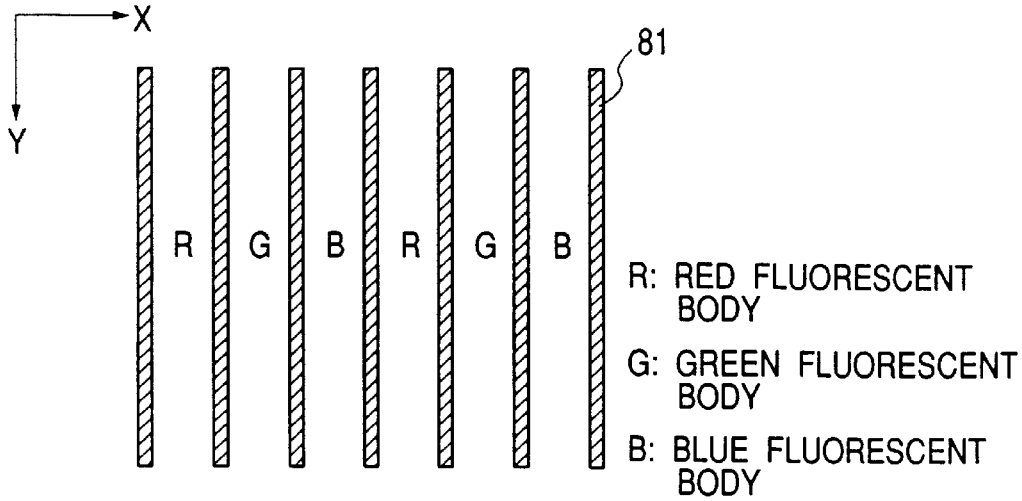
FIGS. 8A and 8B are schematic diagrams showing an example of a fluorescent film used in the embodiment 1.
Figure 8B:
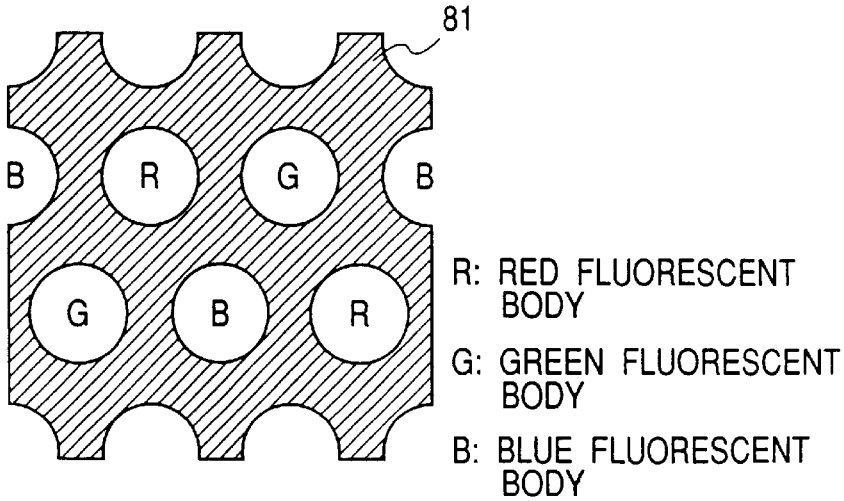

A pattern of separately coating the fluorescent bodies of three primary colors is not limited to the stripe-shaped array shown in FIG. 8A but can be also set to, for example, a delta-shaped array as shown in FIG. 8B or any other array.

In case of forming a monochromatic display panel, it is sufficient to use a monochromatic fluorescent body material for the fluorescent film 68 and the black conductive material is not necessarily used.

A metal back 69 which is well known in the field of the CRT is provided for the surface on the rear plate side of the fluorescent film 68. The purposes of the metal back 69 are to improve a light using ratio by mirror surface reflecting a part of light emitted from the fluorescent film 68, to protect the fluorescent film 68 from the collision of negative ions, to make the metal back act as an electrode to apply an electron beam accelerating voltage, to make the fluorescent film 68 act as a conductive path of the excited electrons, and the like.

The metal back 69 is formed by a method whereby after the fluorescent film 68 is formed on the face plate substrate 67, the surface of the fluorescent film is smoothed, and Al is vacuum evaporation deposited on the smoothed surface. In a case of using a fluorescent body material for a low voltage as a fluorescent film 68, the metal back 69 is not used.

Although not used in this embodiment, for the purpose of applying the accelerating voltage or improving a conductivity of the fluorescent film, for example, a transparent electrode made of a material of ITO, for example, can be also provided between the face plate substrate 67 and fluorescent film 68.

Dx1 to Dxm, Dy1 to Dyn, and Hv indicate electrical connecting terminals with an airtight structure provided to electrically connect the display panel and an electric circuit (not shown), respectively. The terminals Dx1 to Dxm are electrically connected to the row-direction wirings 63 of a multi-electron beam source, the terminals Dy1 to Dyn are electrically connected to the column-direction wirings 64 of the multi-electron beam source, and Hv is electrically connected to the metal back 69 of the face plate, respectively.

A fundamental construction of the image forming apparatus to which the manufacturing method of the invention is applied has been described above. The manufacturing method of the image forming apparatus of the invention will now be described with reference to FIGS. 1A to 1C and 2.

Making of the Rear Plate (R-1)

Lower wirings are formed by a screen printing on the rear plate formed by cleaning the blue plate glass and forming a silicon oxide film by a sputtering method. An interlayer insulating layer is formed between the lower wirings and the upper wirings. Further, the upper wirings are formed. Element electrodes connected to the lower wirings and the upper wirings are subsequently formed.

(R-2)

A conductive thin film made of PdO is formed by the sputtering method and, after that, it is patterned into a desired form.

(R-3)

A frit glass to fix the supporting frame is formed at a desired position by printing.

By the above steps, the rear plate in which the surface conducting type emitting devices which were simple-matrix wired, the adhesive material for the supporting frame, and the like are formed is formed.

Making of the Face Plate (F-1)

The fluorescent bodies and the black conductive bodies are formed onto the blue plate glass substrate by a printing method. The surface on the inner side of the fluorescent film is smoothed. After that, Al is deposited onto the smoothed surface by using a vacuum evaporation deposition or the like, thereby forming the metal back.

(F-2)

The frit glass to fix the supporting frame is formed at a desired position by printing.

By the above steps, the fluorescent bodies in which the fluorescent bodies of three primary colors are arranged in a stripe form, the adhesive material for the supporting frame, and the like are formed on the face plate.

(FR-1)

The face plate, rear plate, and supporting frame formed by the above steps are introduced into the vacuum chamber as a manufacturing apparatus of the invention and are fixed to the heating plates 31 and 34, respectively, and after that, the evacuation is performed (refer to FIG. 1A).

(FR-2)

After the vacuum chamber reaches an adequate degree of vacuum a voltage is applied to the electron emitting devices through the out-of-vessel terminals Dox1 to Doxm and Doy1 to Doyn and the forming step is performed to the conductive thin film 74. After that, acetone is introduced as activating gas at a vacuum degree of $10^{-4}$ Torr, thereby activating.

(FR-3)

The temperature is raised in accordance with a predetermined profile while performing the evacuation. The temperature is raised to a seal bonding temperature while performing the degassing of the activating gas, water, oxygen, carbon monoxide, or the like adsorbed to the face plate and rear plate. Although the seal bonding temperature in this instance is determined by the frit glass which is used for adhesion, it is set to 410° C. in this case.

(FR-4)

After evacuating up a vacuum degree of about $10^{-7}$ Torr, the electron source, face plate, and supporting frame are come into contact with each other and pressed while performing the position matching of the electron source and the face plate by the adjusting stages 30 and 33 of X, Y, and θ while keeping the seal bonding temperature. This state is maintained for 10 minutes. After that, the temperature is reduced at a rate of 3° C. per minute. When the temperature drops by 10° C. from the seal bonding temperature, the position matching is stopped, the stages 30 and 33 are made free, and the annealing is performed to the room temperature (refer to FIG. 1B).

(FR-5)

After annealing to the room temperature, the apparatus is taken out from the vacuum chamber. In order to maintain the vacuum degree after sealing, a gettering process is executed by a high frequency heating method (refer to FIG. 1C).

In the image display apparatus manufactured by the manufacturing method of the invention completed as mentioned above, a scanning signal and a modulation signal are supplied from a signal generating means (not shown) to each of the electron emitting devices through the out-of-vessel terminals Dx1 to Dxm and Dy1 to Dyn, respectively, thereby emitting the electrons. A high voltage of a few kV or higher is applied to the metal back 69 through the high voltage terminal Hv, an electron beam is accelerated and is made collide with the fluorescent film 68, and the fluorescent film is excited and is allowed to emit light, thereby displaying an image.

Thus, there is no positional deviation between the electron emitting device and the fluorescent body and a luminance fluctuation or a color mixture due to the positional deviation is not observed.

Embodiment 2

The second embodiment of the invention relates to an image forming apparatus using the field emitting device as a kind of cold cathode electron emitting devices and relates to a case where a spacer is attached as an atmospheric pressure proofing member in order to realize a light weight.

Figure 9A:
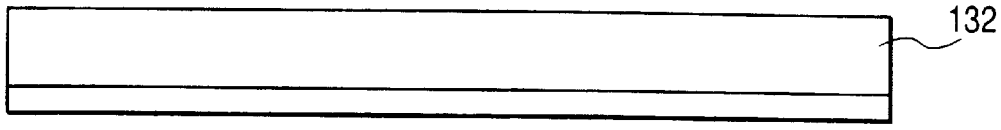
FIGS. 9A and 9B are schematic diagrams showing a field emitting device used in the image forming apparatus manufactured by the embodiment 2.
Figure 9B:
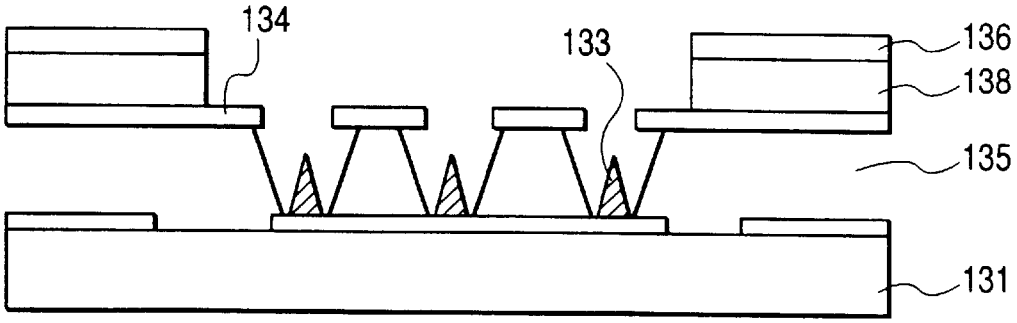
Figure 10A:
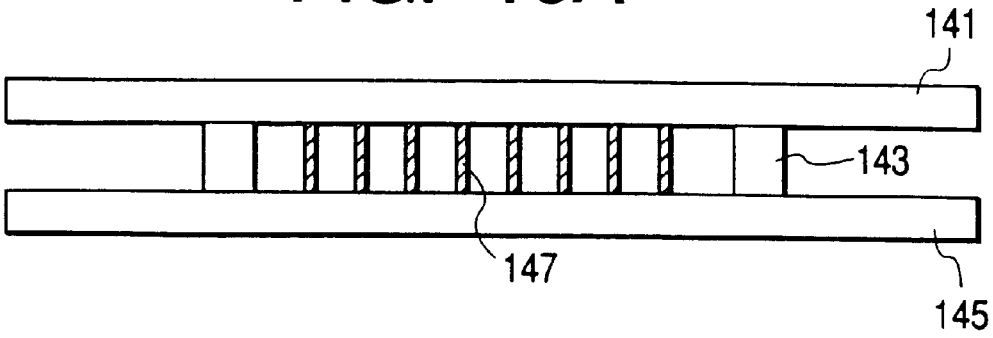
FIGS. 10A and 10B are schematic diagrams showing the image forming apparatus manufactured by the embodiment 2.
Figure 10B:
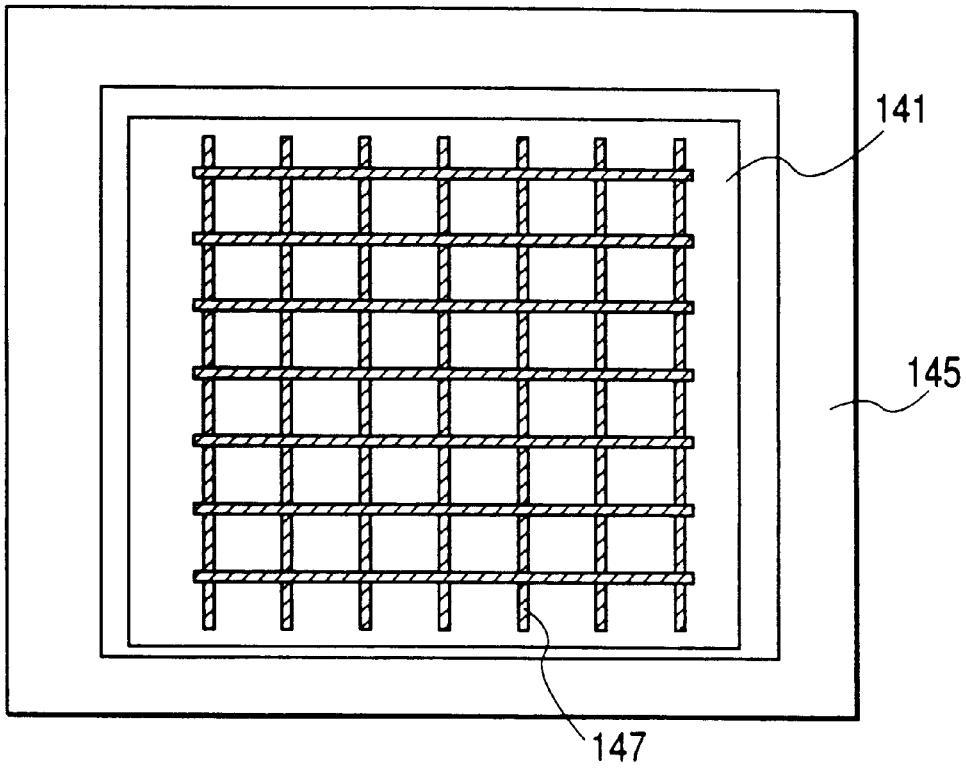

First, the field emitting device will be described with reference to FIGS. 9A and 9B and an image forming apparatus using the field emitting device will be explained with reference to FIGS. 10A and 10B. In FIGS. 9A and 9B, reference numeral 131 denotes a rear plate; 132 a face plate; 133 a cathode; 134 a gate electrode; 135 an insulating layer between the gate and the cathode; 136 a focusing electrode; and 138 an insulating layer between the gate and the focusing electrode. In FIGS. 10A and 10B, reference numeral 141 denotes a face plate; 143 a supporting frame; 145 the rear plate; and 147 a spacer.

A size of valid display area of the image forming apparatus has an aspect ratio of 4:3 and a diagonal line of 10 inches. An interval between the face plate 141 and rear plate 145 is equal to 1.5 mm.

A manufacturing method of the image forming apparatus of the invention will now be described with reference to the flowchart of FIG. 2 and the making conceptual diagram of FIGS. 1A to 1C.

Making of the Rear Plate (R-1)

The blue plate glass is cleaned as a substrate, and a cathode (emitter), a gate electrode, wirings, and the like shown in FIGS. 9A and 9B are formed by a well-known method. Mo is used as a cathode material.

(R-2)

The frit glass to fix the supporting frame is formed at a desired position by printing.

By the above steps, the field emission type emitting devices which are simple-matrix wired and the adhesive material for the supporting frame are formed on the rear plate.

Making of the Face Plate (F-1)

A transparent conductive body, fluorescent bodies, and black conductive bodies are formed on a blue plate glass substrate by a printing method. The surface on the inner side of the fluorescent film is smoothed. After that, Al is deposited by the vacuum evaporation deposition or the like, thereby forming the metal back.

(F-2)

The blue plate glass is used as a substrate and the frit glass to fix the supporting frame is formed at a desired position by printing. Further, a spacer is adhered to the black conductive body by the frit.

By the above steps, the fluorescent bodies in which the fluorescent bodies of three primary colors are arranged in a stripe form, the adhesive material for the supporting frame, the spacer, and the like are formed on the face plate.

(FR-1)

In a manner similar to the embodiment 1, the face plate, rear plate, and supporting frame are introduced into the vacuum chamber and the evacuation is performed.

(FR-2)

The temperature is raised in accordance with a predetermined profile while performing the evacuation. The temperature is elevated to a seal bonding temperature while degassing the water, oxygen, carbon monoxide, or the like. Although the seal bonding temperature in this instance is determined by the frit glass which is used for adhesion, it is set to 410° C. in this case (refer to FIG. 1A).

(FR-3)

The vacuum chamber is evacuated up to a vacuum degree of about $10^{-7}$ Torr and the vacuum vessel is seal bonded. After that, hydrogen is introduced from the introducing pipe 11 into the vacuum chamber in a manner such that a partial pressure of hydrogen is equal to $10^{-5}$ millibar so that hydrogen remains in the vessel. After that, the electron source, face plate, and supporting frame are brought into contact with each other and pressed while performing the position matching of the electron source and the face plate by the adjusting stages 30 and 33 of X, Y, and θ while keeping the seal bonding temperature. After this state is maintained for 10 minutes, the temperature is reduced at a rate of 3° C. per minute. When the temperature is reduced by 10° C. from the seal bonding temperature, the position matching is stopped, the stages 30 and 33 are made free, and the annealing is performed up to the room temperature (refer to FIG. 1B).

(FR-4)

After annealing to the room temperature, the apparatus is taken out from the vacuum chamber and a gettering process is executed by a high frequency heating method in order to maintain a vacuum degree after sealing (refer to FIG. 1C).

In the image display apparatus shown in FIGS. 10A and 10B according to the manufacturing method of the invention completed as mentioned above, a signal is supplied from a signal generating means (not shown) to each of the electron emitting devices through the out-of-vessel terminals, respectively, thereby emitting electrons. A high voltage of 2 kV is applied to the metal back through the high voltage terminal Hv, the electron beam is accelerated and is made to collide with and the fluorescent film, the fluorescent film is allowed to excite and emit light, thereby displaying an image. Thus, there is no positional deviation between the electron emitting devices and the fluorescent bodies, and luminance fluctuation and color mixture which are caused by the positional deviation are not observed.

Embodiment 3

Figure 4:
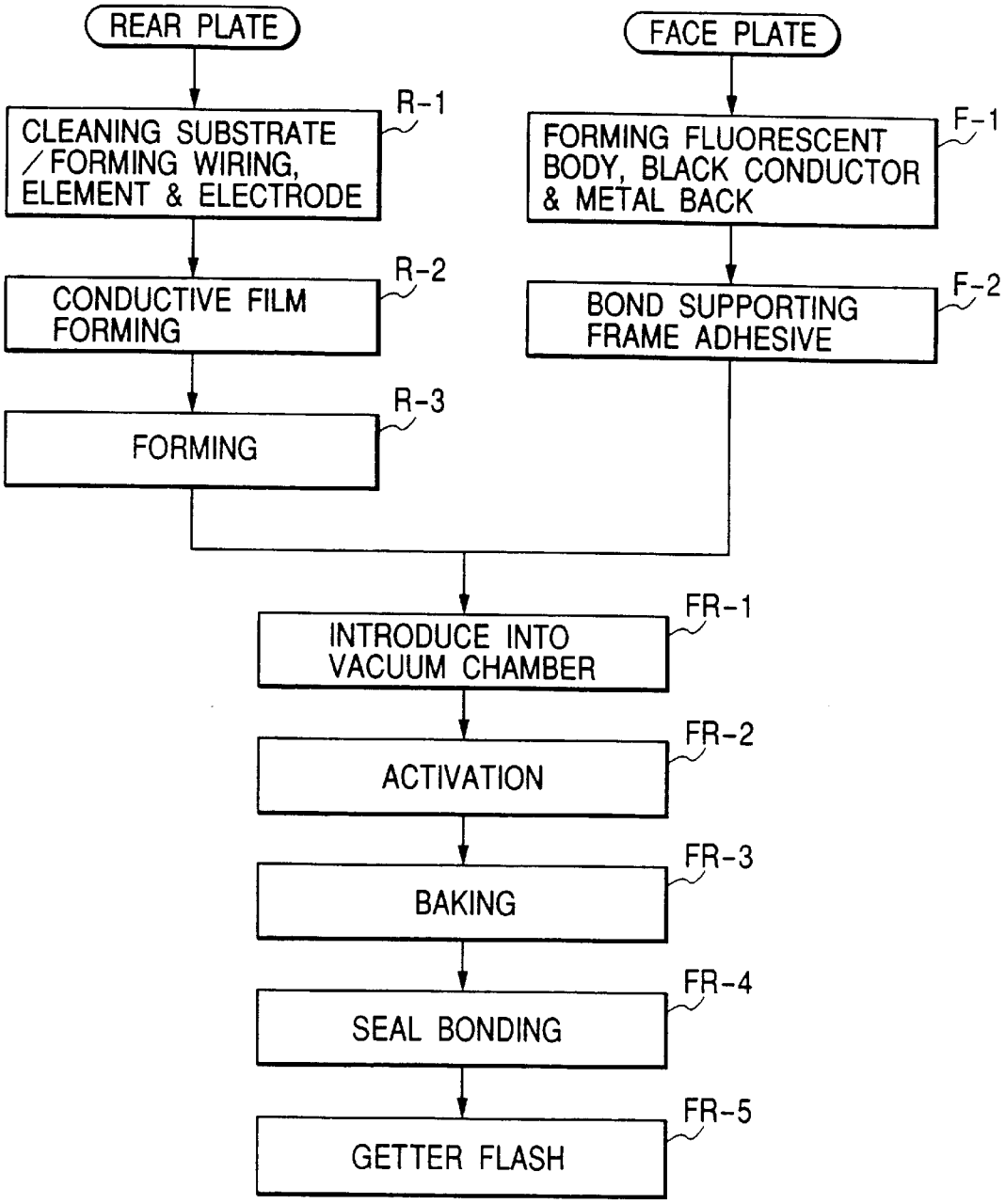
FIG. 4 is a block diagram showing a flow for a manufacturing step of a manufacturing method of an image forming apparatus according to an embodiment 3.
Figure 5:
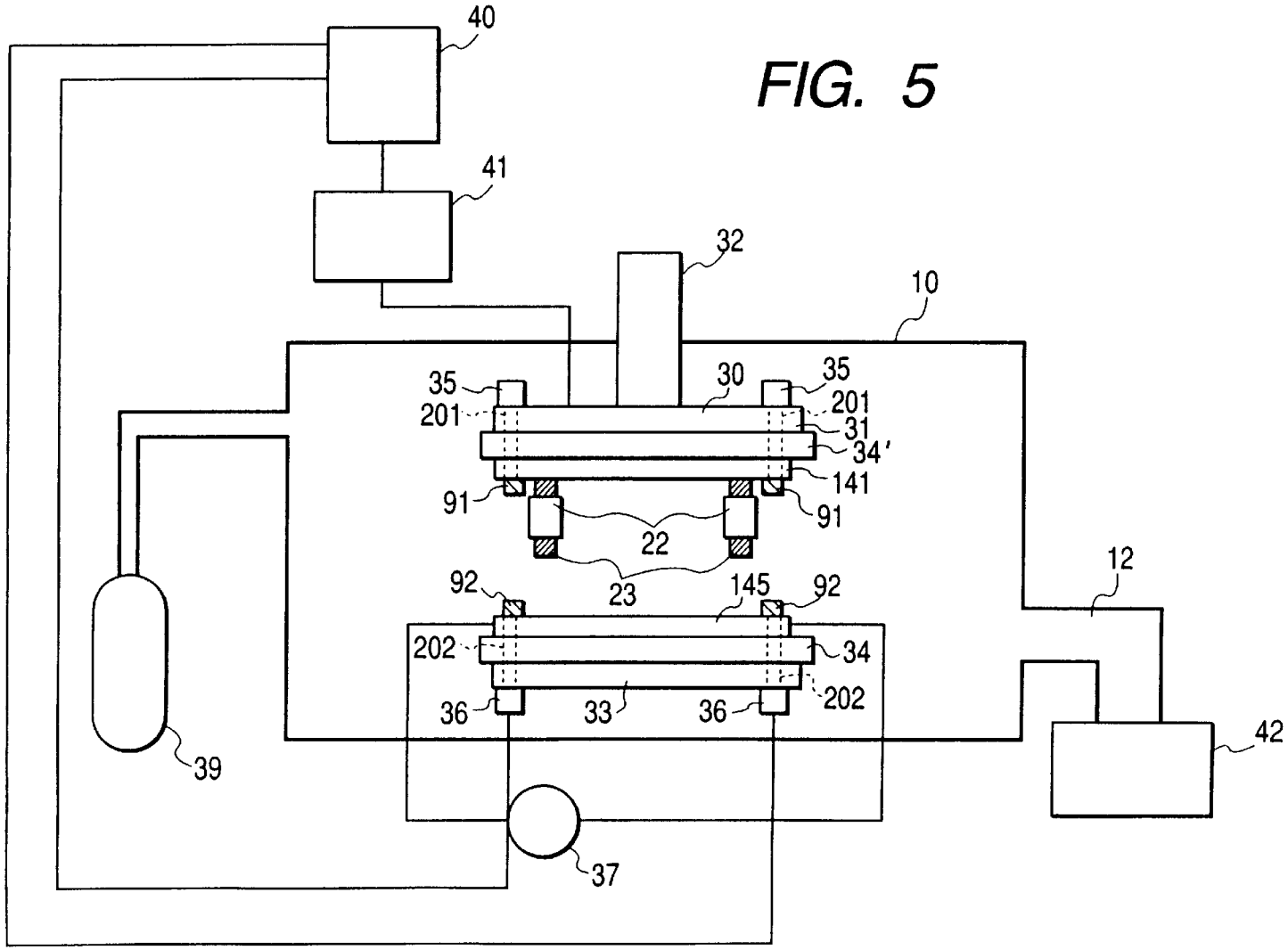
FIG. 5 is a schematic diagram showing an example of a manufacturing apparatus of an image forming apparatus of the invention.

The embodiment relates to an example of a manufacturing apparatus of the image forming apparatus using the surface conducting type electron emitting device and will be explained hereinbelow with reference to a flowchart of FIG. 4 and an apparatus schematic diagram of FIG. 5. First, the apparatus will be explained.

In the manufacturing apparatus of the embodiment, reference numeral 10 denotes the load locking type vacuum chamber; 42 an oil-free evacuating apparatus; 39 a gas cylinder which is used in the activating step; 37 a voltage source which is used in the forming and activating steps; 34 the rear plate heating apparatus; 34' a face plate heating apparatus; 30 and 33 the position fine adjusting mechanisms of the rear plate and the face plate; 32 the mechanism for moving the face plate or rear plate in the Z-axis direction and pressing the face plate and the rear plate; 36 CCDs serving as detecting means for observing positions of position matching patterns (alignment marks) formed on the face plate and the rear plate; and 35 light sources for irradiating the position matching patterns (alignment marks) formed on the rear plate and the patterns formed on the face plate. Reference numeral 40 denotes an image recognizing/arithmetic operating apparatus for receiving signals from the CCDs 36 and calculating a relative positional relation between the face plate and the rear plate; and 41 a position control apparatus for feeding back information to the X, Y, and θ adjusting stage of the face plate on the basis of information from the apparatus 40.

The same component elements as those in FIGS. 1A to 1C are designated by the same reference numerals. The CCDs 36 observe the position matching patterns formed on the face plate and the rear plate through observing holes 201 and 202 formed in the heating plates 34' and 34 of the position adjusting stages 30 and 33, respectively.

The image recognizing/arithmetic operating apparatus 40 receives the signals from the CCDs 36, synthesizes the corresponding position matching patterns to one picture plane, and calculates the relative positional relation. The position control apparatus 41 controls the X, Y, and θ adjusting stage so that the relative positional relation is set to a predetermined positional relation. The face plate 141 and rear plate 145 can be held so as to have the predetermined positional relation.

The voltage source 37 for applying the voltage for activation can be also used for forming. In the embodiment, the adjustment of the relative positions between the face plate and the rear plate is performed by using only the X, Y, and θ adjusting stage 30 of the face plate. The manufacturing method will now be described.

Forming Step of the Face Plate (F-1)

The fluorescent bodies and the black conductive bodies are formed on the blue plate glass substrate by the printing method. The surface on the inner side of the fluorescent film is smoothed. After that, Al is deposited by using the vacuum evaporation deposition or the like, thereby forming the metal back.

(F-2)

The supporting frame having a height (interval between the face plate and the rear plate) of 2 mm is adhered to the peripheral edge portion of the face plate by the frit glass. The frit glass is arranged in the joining portion of the supporting frame with the rear plate by a dispenser method.

Making of the Rear Plate (R-1)

In a manner similar to the embodiment 1, the lower wirings are formed by the screen printing on the rear plate obtained by cleaning the blue plate glass and forming the silicon oxide film by the sputtering method. An interlayer insulating layer is formed between the lower wirings and the upper wirings. The upper wirings are further formed. The element electrodes connected to the lower wirings and the upper wirings are formed.

(R-2)

After the conductive thin film made of PdO was formed by the sputtering method, it is patterned in a desired shape.

(R-3)

A voltage is applied to the conductive thin film formed between the element electrodes through the upper wirings and the lower wirings and the forming is performed.

By the above steps, the rear plate is formed.

(FR-1)

The face plate and the rear plate formed by the above steps are introduced into the vacuum chamber and are fixed to the heating apparatuses 34 and 34', respectively. After that, the evacuation is performed.

(FR-2)

In a state where the interval between the face plate and the rear plate is set to 10 cm, acetone is introduced as activating gas at a vacuum degree of $10^{-4}$ Torr through a gas flow rate control apparatus (not shown). A voltage is applied by the voltage source 37 for activation, thereby activating.

(FR-3)

The temperature is raised in accordance with a predetermined profile while performing the evacuation. The temperature is elevated to the seal bonding temperature while degassing the activating gas, water, oxygen, carbon monoxide, or the like which was adsorbed. Although the seal bonding temperature at this time is determined by the frit glass which is used for adhesion, it is set to 410° C. in this case.

(FR-4)

After evacuating to a vacuum degree of about $10^{-7}$ Torr, the face plate 141 is descended by the pressurizing and Z-axis moving mechanisms while performing the position matching of the rear plate and the face plate by the adjusting stage 30 of X, Y, and θ while keeping the seal bonding temperature. The rear plate, face plate, and supporting frame are brought into contact with each other and are pressed. This state is maintained for 10 minutes. After that, the temperature is reduced at a rate of 3° C. per minute. When the temperature decreases by 10° C. from the seal bonding temperature, the position matching is stopped and the fixture of the rear plate fixed to the heating plate 34 is cancelled, thereby enabling the rear plate to be freely moved in the X and Y directions. Subsequently, the annealing is performed to room temperature.

(FR-5)

After annealing to a about room temperature, the apparatus is taken out from the vacuum chamber. To maintain the vacuum degree after sealing, a gettering process is performed by the high frequency heating method.

In the image display apparatus shown in FIG. 6 manufactured by the manufacturing method of the invention and completed as mentioned above, the scanning signal and modulation signal are supplied from the signal generating means (not shown) to each of the electron emitting devices through the out-of-vessel terminals Dx1 to Dxm and Dy1 to Dyn, respectively, thereby emitting electrons. A high voltage of 4 kV is applied to the metal back 69 through the high voltage terminal Hv. The electron beam is accelerated and is made collide with the fluorescent film 68 and the fluorescent film is allowed to excite and emit light, thereby displaying an image.

Thus, there is no positional deviation between the electron emitting devices and the fluorescent bodies. A luminance fluctuation and color mixture which are caused by the positional deviation are not observed.

Embodiment 4

In the embodiment, an example in which an image signal is inputted to the image forming apparatus manufactured by embodiment 1 and an image is displayed is shown.

First, the scanning signal and the modulation signal are formed from the inputted image signal. The modulation signals are respectively inputted through the terminals Dy1 to Dyn while sequentially scanning the out-of-vessel terminals Dx1 to Dxm in accordance with the scanning signal, respectively.

In this embodiment, an accurate image can be displayed. This is because the emitted electrons are irradiated to a predetermined position.

As mentioned with respect to each of the embodiments, according to the manufacturing method of the image forming apparatus of the invention, the vacuum envelope is formed by adhering the members while keeping the electron source and the image forming member in a predetermined positional relation at a temperature near the seal bonding temperature. Therefore, the deviation of the relative positions due to the thermal expansion, softening of the frit glass, or the like can be corrected. The electron source substrate and the face plate can be adhered at a high positional precision. The high quality image forming apparatus in which there is no luminance fluctuation and color mixture due to the positional deviation can be manufactured.

The electron source substrate and the face plate are separated at only a distance such that the enough conductance for the gas can be obtained, the temperature is raised up to the seal bonding temperature, and the degassing from the members is sufficiently performed. After that, by adhering them, the vacuum vessel of a high vacuum degree can be formed and the stable electron emitting characteristics can be obtained.

In a case of using the surface conducting type electron emitting device, the electron source substrate and the face plate are separated by only a distance such that an adequate conductance for the gas can be obtained and the activating gas is introduced. Thus, the activating gas can be easily introduced to the electron source substrate and the activation can be uniformly performed. The characteristics of the electron emitting devices are matched. Therefore, when the image forming apparatus is formed, the image forming apparatus having an excellent display quality without a luminance fluctuation is manufactured.

By raising up to the seal bonding temperature with the electron source substrate and the face plate away from each other and by evacuating and seal bonding, these processes can be commonly performed together with the step of removing the activating gas or the like adhered to the members. Therefore, there are typical advantages such that the improvement of the vacuum degree which exerts an influence on the electron emitting characteristics and the reduction of the thermal processing step are realized, the stable image forming apparatus of a high quality is manufactured, and the like.

What is claimed is:

1. A method of manufacturing an image display apparatus comprising a first substrate, a second substrate, and a joining member through which said first and second substrates are seal bonded, the method comprising the steps of:

(a) heating said first and second substrates and said joining member to a seal bonding temperature, while holding said first and second substrates between first and second heaters within a chamber so that said joining member disposed at a side of said first substrate does not contact a side of said second substrate, and while evacuating an inside of said chamber; and (b) joining said first and second substrates together through said joining member under a condition of evacuating the inside of said chamber, to cause said first and second substrates to become seal bonded together through said joining member.

2. A method according to claim 1, wherein said joining step includes joining said first and second substrates together through said joining member and a supporting frame under a condition of evacuating the inside of said chamber, to cause said first and second substrates to become seal bonded together through said joining member and said supporting frame.

3. A method according to claim 2, wherein said step of heating is conducted while said first and second substrates are arranged in opposition to each other and separated by an interval greater than a height of said supporting frame.

4. A method according to claim 1, wherein a phosphor and a phosphor exciting means are disposed within an air tight space which is formed between said first and second substrates.

5. A method according to claim 1, wherein a phosphor and an electron-emitting device are disposed within an air tight space which is formed between said first and second substrates.

6. A method according to claim 5, wherein said electron-emitting device is a surface conduction electron-emitting device.

7. A method according to claim 6, further comprising, before said joining step, a step of forming said surface conduction electron-emitting device.

8. A method according to claim 7, further comprising, after said forming step, and before said joining step, a step of activating said surface conduction electron-emitting device.

9. A method according to claim 5, wherein said electron-emitting device is a field emission type electron-emitting device.

10. A method according to claim 1, wherein said joining member is a low melting point glass frit.

11. A method according to claim 1, wherein said image display apparatus further comprises a phosphor exciting means arranged on said first substrate, and a phosphor which emits light using said phosphor exciting means, arranged on said second substrate.

12. A method of manufacturing an image display apparatus having a first substrate, a second substrate, and a joining member, wherein said first and second substrates are arranged in opposition to each other, and an air tight space is formed between said first and second substrates, the method comprising steps of:

(a) heating said first and second substrates and said joining member to a seal bonding temperature, while holding said first and second substrates between first and second heaters within a chamber so that said joining member disposed at a side of said first substrate does not contact a side of said second substrate, and while evacuating an inside of said chamber; and (b) after said heating step, and under a condition that hydrogen or a gas producing a plasma is introduced into said chamber, joining said first and second substrates together through said joining member to cause said first and second substrates to become seal bonded together through said joining member.

13. A method of according to claim 12, wherein a phosphor and a phosphor exciting means are disposed within the air tight space.

14. A method according to claim 12, wherein said image display apparatus further comprises a phosphor, and a phosphor exciting means, and wherein said phosphor and said phosphor exciting means are disposed within the air tight space.

15. A method of manufacturing an image display apparatus comprising a first substrate, a second substrate, and a joining member through which said first and second substrates are seal bonded, the method comprising the steps of:

(a) heating said first and second substrates and said joining member, while holding said first and second substrates within a chamber so that said joining member disposed at a side of said first substrate does not contact a side of said second substrate, and while evacuating an inside of said chamber;

(b) under a condition of evacuating the inside of said chamber, displacing together a heater which heats at least one of said first and second substrates in said heating step and said at least one of said first and second substrates so that said first and second substrates near each other; and (c) joining said first and second substrates together through said joining member under a condition of evacuating the inside of said chamber, to cause said first and second substrates to become seal bonded together through said joining member.

16. A method according to claims 15, wherein in said joining step, said first and second substrates become joined together through said joining member and a supporting frame.

17. A method according to claim 16, wherein said heating step is conducted while said first and second substrates are arranged in opposition to each other and separated by an interval greater than a height of said supporting frame.

18. A method according to claim 15, wherein a phosphor and a phosphor exciting means are disposed within an air tight space which is formed between said first and second substrates.

19. A method according to claim 15, wherein a phosphor and an electron emitting device are disposed within an air tight space which is formed between said first and second substrates.

20. A method according to claim 19, wherein said electron-emitting device is a surface conduction electron-emitting device.

21. A method according to claim 20, further comprising, before said displacing step, a step of forming said surface conduction electron-emitting device.

22. A method according to claim 21, further comprising, after said forming step, and before said displacing step, a step of activating said surface conduction electron-emitting device.

23. A method according to claim 19, wherein said electron-emitting device is a field emission type electron-emitting device.

24. A method according to claim 15, wherein said joining member is a low melting point glass frit.

25. A method according to claim 15, wherein said image display apparatus further comprises a phosphor exciting means arranged on said first substrate, and a phosphor which emits light using said phosphor exciting means, arranged on said second substrate.

26. A method of manufacturing an image display apparatus having a first substrate, a second substrate, and a joining member, wherein said first and second substrates are arranged in opposition to each other, and an air tight space is formed between said first and second substrates, the method comprising steps of:

(a) heating said first and second substrates and said joining member, while holding said substrates within a chamber so that said joining member disposed at a side of said first substrate does not contact a side of said second substrate, and while evacuating an inside of said chamber;

(b) after said heating step, under a condition that hydrogen or a gas producing a plasma is introduced into said chamber, displacing together a heater which heats at least one of said first and second substrates in said heating step and said at least one of said first and second substrates so that said first and second substrates near each other; and (c) joining said first and second substrates together through said joining member under a condition that hydrogen or the gas producing the plasma is introduced into said chamber, to cause said first and second substrates to become seal bonded together through said joining member.

27. A method according to claim 26, wherein a phosphor and a phosphor exciting means are disposed within the air tight space.

28. A method according to claim 26, wherein said image display apparatus further comprises a phosphor and a phosphor exciting means, and wherein said phosphor and said phosphor exciting means are disposed within the air tight space.

* * * * *

UNITED STATES PATENT AND TRADEMARK OFFICE

CERTIFICATE OF CORRECTION

PATENT NO. : 6,506,089 B2 
DATED : January 14, 2003
INVENTOR(S) : Koichiro Nakanishi et al.

It is certified that error appears in the above-identified patent and that said Letters Patent is hereby corrected as shown below:

Title page, Item [54] and Column 1, lines 1-5,
"MANUFACTURING METHOD OF IMAGE FORMING APPARATUS, MANUFACTURING APPARATUS OF IMAGE FORMING APPARATUS, AND MANUFACTURING METHOD OF PANEL APPARATUS" should read
-- MANUFACTURING METHOD OF IMAGE FORMING APPARATUS, MANUFACTURING APPARATUS OF IMAGE FORMING APPARATUS, IMAGE FORMING APPARATUS, MANUFACTURING METHOD OF PANEL APPARATUS, AND MANUFACTURING APPARATUS OF PANEL APPARATUS --.

Title page,
Item [57], ABSTRACT,
Line 11, "members" should read -- member --.

Column 1,
Line 20, "device" (second occurrence) should read -- device, --;
Line 23, "FE" should read -- "FE" --;
Line 24, "MIM" should read -- "MIM" --; and
Line 29, "Field," should read -- Field --.

Column 2,
Line 18, "or/and its compound" should read -- and/or a compound of carbon --;
Line 47, "a" should be deleted; and
Line 48, "adhered," should read -- adhered -- and "them" should read -- them, --.

Column 4,
Line 41, "an enough" should read -- a sufficient --; and
Line 49, "an enough" should read -- a sufficient --.

Column 6,
Line 12, "Further" should read -- Further, the --.

Column 7,
Line 61, "the; and" should read -- the --; and
Line 62, "frit" should read -- frit, --.

UNITED STATES PATENT AND TRADEMARK OFFICE

CERTIFICATE OF CORRECTION

PATENT NO. : 6,506,089 B2
DATED : January 14, 2003
INVENTOR(S) : Koichiro Nakanishi et al.

It is certified that error appears in the above-identified patent and that said Letters Patent is hereby corrected as shown below:

Column 8,
Line 26, "(although)" should read -- (although --; and
Line 27, "reduced" should read -- is reduced --.

Column 9,
Line 6, "embodiment" should read -- embodiment; --; and
Line 64, "be also" should read -- also be --.

Column 10,
Line 6, "light using" should read -- light-using --.

Column 11,
Line 15, "vacuum a" should read -- vacuum, a --;
Line 31, "up" should read -- up to --;
Line 33, "come" should read -- brought --; and
Line 57, "collide" should read -- to collide --.

Column 12,
Line 47, "substrate" should read -- substrate, --.

Column 13,
Line 32, "and" should be deleted and "film, the" should read -- film, and the --; and
Line 40, "The" should read -- This --.

Column 15,
Line 27, "a" should be deleted;
Line 40, "collide" should read -- to collide --; and
Line 49, "the" should read -- this --.

Column 16,
Line 8, "enough" should read -- sufficient --;
Line 65, "air tight" should read -- airtight --.

Column 17,
Lines 2, 27, 45 and 49, "air tight" should read -- airtight --; and
Line 43, "method of" should read -- method --;

UNITED STATES PATENT AND TRADEMARK OFFICE

CERTIFICATE OF CORRECTION

PATENT NO. : 6,506,089 B2 
DATED : January 14, 2003
INVENTOR(S) : Koichiro Nakanishi et al.

It is certified that error appears in the above-identified patent and that said Letters Patent is hereby corrected as shown below:

Column 18,
Line 6, "claims 15," should read -- claim 15, --;
Line 15, "air" should read -- air- --;
Line 19, "electron emitting" should read -- electron-emitting -- and "air" should read -- air- --; and
Line 45, "air tight" should read -- airtight --.

Column 19,
Line 2, "air" should read -- air- --.

Column 20,
Line 2, "air tight" should read -- airtight --.

Signed and Sealed this

Twenty-seventh Day of January, 2004

JON W. DUDAS
*Acting Director of the United States Patent and Trademark Office*